United States Patent [19]

Price

[11] Patent Number: 4,738,584

[45] Date of Patent: Apr. 19, 1988

[54] MULTIPLE IMPELLER PUMP

[76] Inventor: Carl Price, 17820 Twilight La., Encino, Calif. 91316

[21] Appl. No.: 889,694

[22] Filed: Jul. 28, 1986

[51] Int. Cl.[4] ..... F04D 17/12

[52] U.S. Cl. ..... 415/60; 417/426; 415/203

[58] Field of Search ..... 415/60, 61, 203, 206, 415/121 G; 416/120, 122, 123; 417/426; 366/300

[56] References Cited

U.S. PATENT DOCUMENTS

| | | | |
|---|---|---|---|
| 2,634,048 | 4/1953 | McDonald | 415/60 |
| 3,183,838 | 5/1965 | Englesson | 415/60 |
| 3,689,931 | 9/1972 | Fortis | 416/206 |
| 3,828,661 | 8/1974 | Vink | 366/300 X |
| 3,957,402 | 5/1976 | Sloan | 415/121 G X |
| 4,088,419 | 5/1978 | Hope et al. | 415/60 X |
| 4,177,018 | 12/1979 | Granet | 417/428 X |
| 4,405,286 | 9/1983 | Studer | 418/201 X |
| 4,474,479 | 10/1984 | Redelman | 366/300 |

FOREIGN PATENT DOCUMENTS

| | | | |
|---|---|---|---|
| 2102351 | 7/1971 | Fed. Rep. of Germany | 417/426 |
| 7605410 | 11/1977 | Netherlands | 417/426 |

*Primary Examiner*—Robert E. Garrett
*Assistant Examiner*—Joseph M. Pitko
*Attorney, Agent, or Firm*—Gerald L. Price

[57] ABSTRACT

A dual impeller recirculating pump having a plurality of simultaneously activated motors with counterrotating shafts coupled to the motors. An impeller is coupled to each shaft and rotated thereby. The impellers rotate within an impeller housing divided into individual sections, each section opening into a common outlet coupled so that counter rotation of the impellers forces water entering the housing sections out of each section into the common outlet which acts as a mixing chamber merging the fluid flow and thus increasing the flow rate and efficiency of the pump.

9 Claims, 4 Drawing Sheets

MULTIPLE IMPELLER PUMP

BACKGROUND OF THE INVENTION

1. Field of the Invention

The invention relates to recirculating pumps; and, more particularly, to an impeller pump having dual motors driving dual counterrotating impellers to increase the efficiency and flow rate of the fluid flow of the pump.

2. Description of the Prior Art

Recirculating pumps are well known in the prior art. Such pumps include a motor rotating an impeller shaft, the impeller shaft having an impeller secured thereto rotating within an impeller housing connected to the motor housing. The impeller housing has an inlet for introducing water therein and an outlet whereby the impeller blades force water thereout under pressure. Various types of such pumps are known and are of varying horespower. These pumps may be of the open air or submersible type and may be operated in various positions depending on the environment. The gallons per hour of fluid flow is thus increased by incresing the horsepower of such pumps.

As a general rule, the only way to increase fluid flow of such prior art pumps, or to provide a back-up for a pump in case of failure, is to increase the number of such pumps. This of course adds appreciably to the cost.

In U.S. Pat. No. 2,810,345 to Englesson, dual motor pumps are employed having a single inlet and outlet. The pump of Englesson is primarily used to run either of the two impellers so that one impeller can be used as a back-up for the other. The arrangement of Englesson eliminates the complicated valve systems used before Englesson to alternately run two pump units. There is no suggestion of using the two impellers to increase the efficiency of the fluid flow.

In U.S. Pat. No. 3,935,971 to Papoff et al, two interdependent pumps are used where one pump or both pumps may be operated and the flow rate of each pump is adjusted to provide for the mixing of two materials. Two pumps are necessary to carry out the invention and no suggestion is made for using the two pumps to increase the efficiency of the water flow output.

Two entirely independent pumps used to either pump water from one or the other, or both, is disclosed in U.S. Pat. No. 3,602,611. Again, two separate pumps are necessary and no suggestion is made as to increasing the efficiency of the fluid flow.

There is thus a need for a pump which obtains the increased water flow provided by a plurality of pumps without the need for separate independent pumps.

SUMMARY OF THE INVENTION

It is an object of this invention to provide a dual impeller pump for increasing the fluid flow rate of the pump.

It is a further object of this invention to provide a dual impeller pump having simultaneously activated motor driven impellers which impellers rotate in individual housing sections leading to a common outlet thereby increasing fluid flow.

It is still further an object of this invention to carry out the foregoing object by counterrotation of the impellers and predetermined selection of the openings in the housing sections leading to the common outlet.

These and other objects are preferably accomplished by providing a pump having at least a pair of simultaneously activated motors with counterrotating shafts coupled to the motors. Impellers are coupled to the shafts and the impellers rotate within an impeller housing divided into sections, each impeller rotating in a section, each section opening into a common outlet coupled so that counterrotation of the impellers forces fluid entering the housing sections out of each section into the common outlet which acts as a mixing chamber merging the fluid flow and thus increasing the flow rate and efficiency of the pump.

DESCRIPTION OF THE PREFERRED EMBODIMENTS

Figure 1:
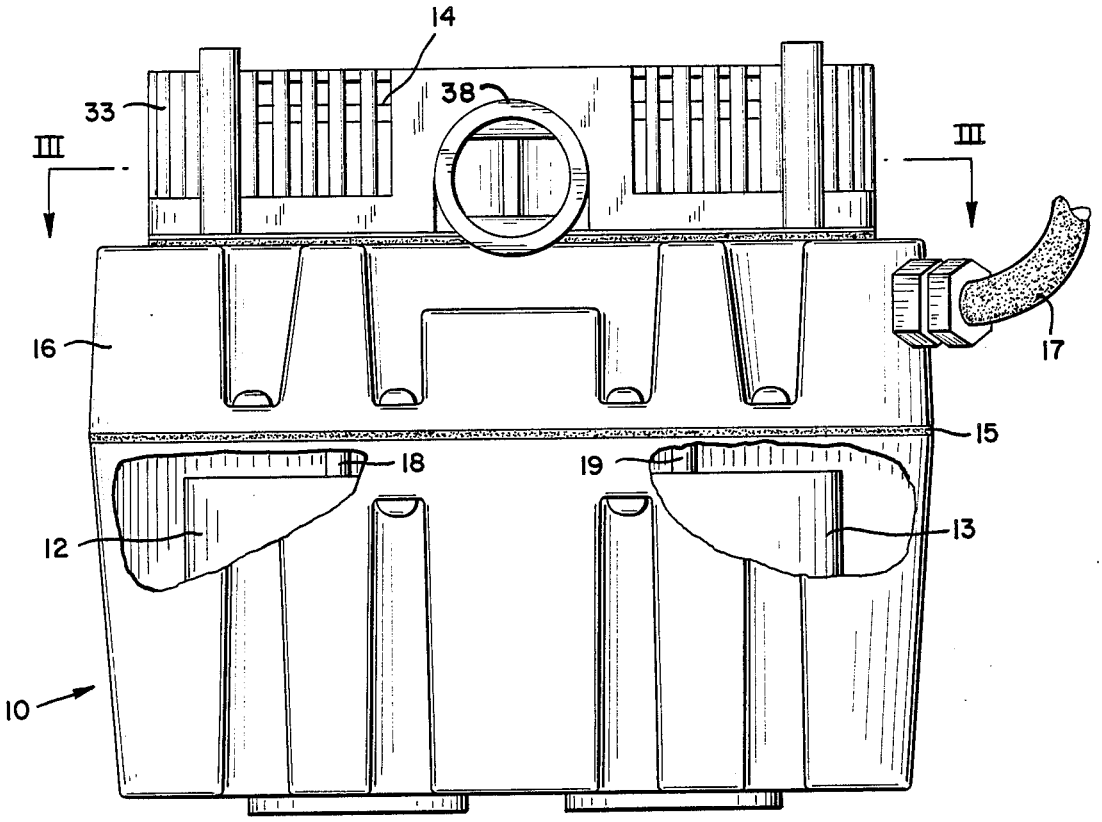
FIG. 1 is a vertical view, partly in section, of a pump in accordance with the teachings of the invention.
Figure 2:
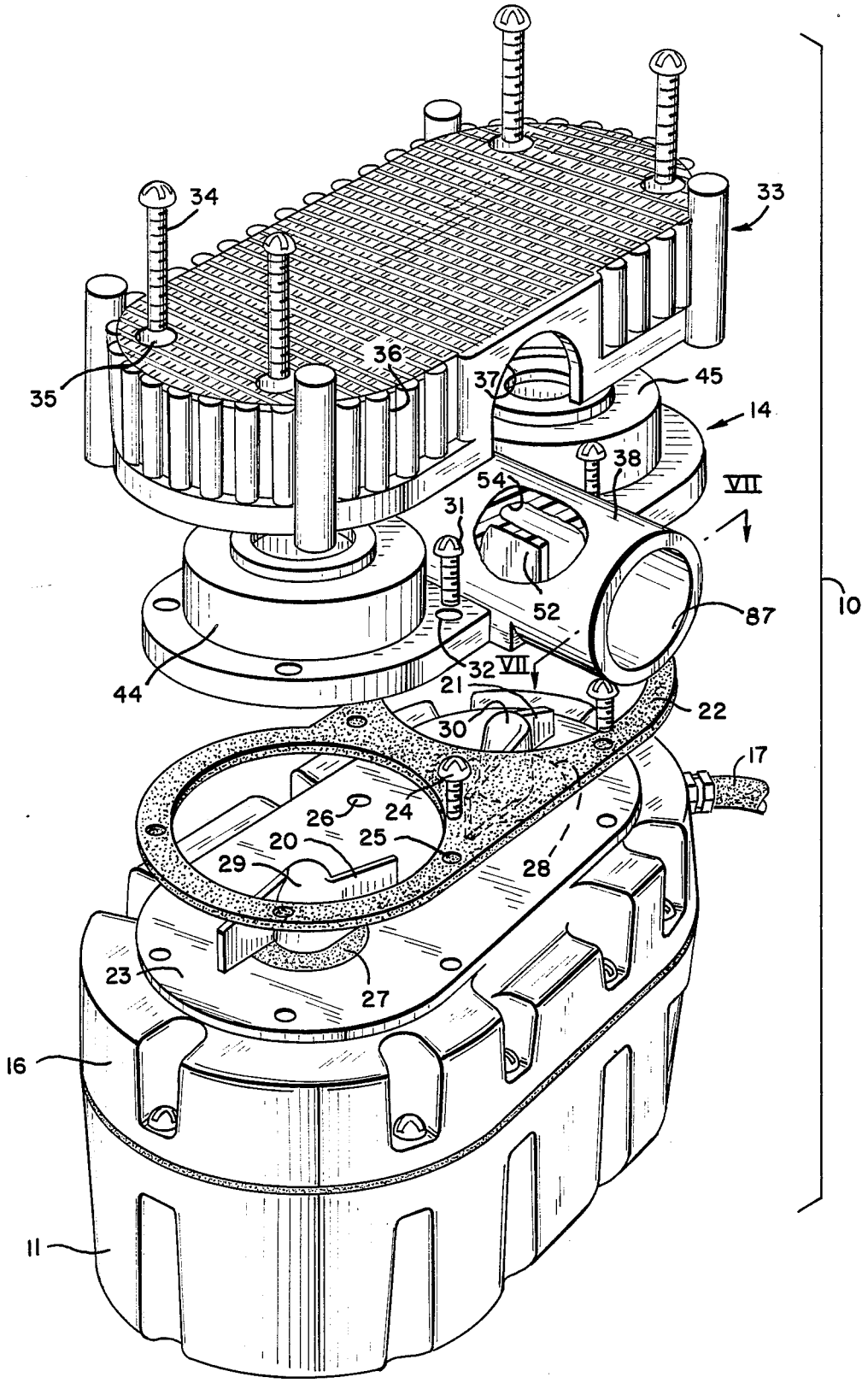
FIG. 2 is an exploded view of the pump of FIG. 1.

Referring now to FIGS. 1 and 2 of the drawing, a pump 10 is shown which pump is preferably an impeller pump and may be either a submersible or open air pump. Such pumps are designed to operate in open air or may be fully submersible. Thus, pump 10 includes a main motor housing 11 adapted to contain therein a plurality of motors, such as motors 12 and 13 (FIG. 1). Motors 12 and 13 are are independent motors mounted within housing 11 and adapted to rotate independent impellers mounted in impeller housing 14 (FIG. 2).

Suitable electrical means and bearing means, not shown, as is well known in the art, are mounted in housing section 16 between impeller housing 14 and motor housing 11. A resilient gasket 15 separates housing 11 from housing section 16. An electrical conduit 17 extends out of housing section 16 to a plug (not shown) for coupling the same to a suitable power supply and is electrically coupled to motors 12 and 13 for simultaneous operation thereof as is well known in the pump art.

It is to be understood that conduit 17 is electrically coupled to motors 12, 13 to activate the same simultaneously. Any suitable motors may be used, such as a matched pair of 115 volt, 60 cycle, single, ¼ h.p., 6 amp, heavy duty motors.

The pump body and motor enclosure may be constructed of brass for corrosion resistance in water, both salt and fresh, mild acids, etc., and may be operated in any position. The motors 12, 13 are sealed in oil for permanent lubrication and efficient heat transfer. Suitable seals may be used throughout as is well known in the pump art and the impellers may be of nylon or other suitable material mounted on the respective motor shafts 18, 19, respectively, of motors 12 and 13. Shafts 18, 19 are journalled for rotation is suitable bearings mounted in housing section 16 all as is well known in the pump art and further discussion thereof is deemed unnecessary. For purposes of carrying out the teachings of the invention, it is only necessary that at least a pair of suitable motors are housed in housing 11 having shafts rotating impellers within impeller housing 14. Further, the motors are reversible so that one of the shafts may be rotated in a direction reverse that of the direction of rotation of the shaft of the other motor.

Thus, as seen in FIG. 2, a pair of impellers 20, 21 are fixedly secured to the upper ends of shafts 18, 19, respectively (FIG. 1) extending out of housing 16. A resilient double O-ring gasket 22 is disposed on the upper surface 23 of housing section 16 and secured thereto by suitable bolts 24 passing through threaded holes 25 in gasket 22 and into suitable threaded holes 26 in the upper surface of housing 16. The shafts 18, 19 extend through resilient seals 27, 28 mounted in housing section 16 as is well known in the pump art thus sealing off the shafts 18, 19 from the atmosphere. The impellers 20, 21 each have a main hub 29, 30, respectively, keyed to its respective shaft. The impeller housing 14 is now placed on top of housing section 16 and secured thereto by a pluarality of bolts 31 entering holes 32 in housing 14 and into suitable threaded aligned holes 26 on the upper surface of housing section 16. If desired, a screen filter 33 is now placed over impeller housing 14 and secured to the upper surface 23 of housing section 16 by threaded bolts 34 extending through suitable holes 35 in filter 33 and into aligned holes 26 (threaded) in housing section 16. As seen in FIG. 2, filter 33 has a plurality of spaced openings 36 for permitting fluid to flow therethrough while preventing extraneous material from entering pump 10. The filter 33 also includes an arcuate cut-out area 37 adapted to straddle fluid outlet 38 on impeller housing 14 as will be discussed.

Figure 3:
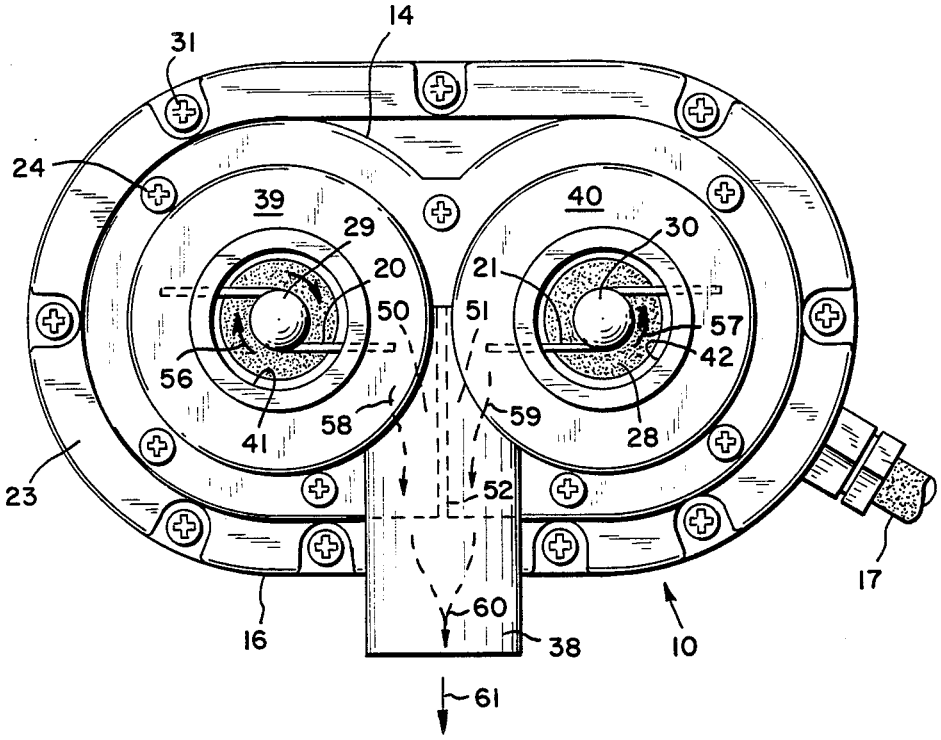
FIG. 3 is a view taken along lines III—III of FIG. 1, the filter being removed therefrom for convenience of illustration.
Figure 4:
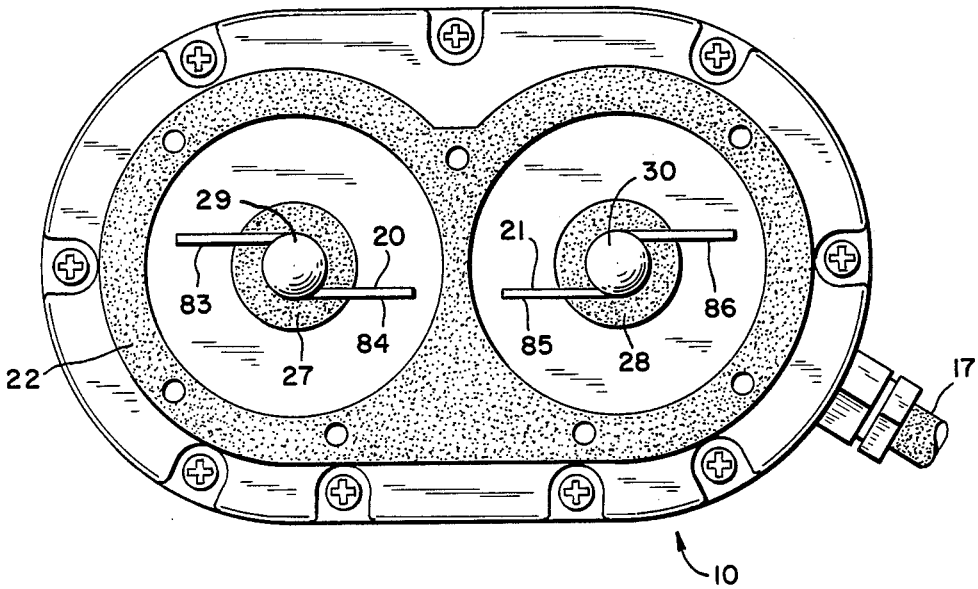
FIG. 4 is a view similar to FIG. 3 with one component thereof removed from the device for convenience of illustration.

The assembled pump 10 is shown in FIG. 1. As heretofore discussed, filter 33 may be eliminated, if desired, depending upon the environment in which pump 10 is used. As seen in FIG. 3, where the filter 33 has been eliminated for convenience of illustration, it can be seen that impeller housing 14 is divided into two sections 39, 40. Impeller 20 rotates within section 39 and impeller 21 rotates within section 40. Each section 39, 40 has a circular opening 41, 42, respectively, providing fluid inlets into the interior of sections 39 and 40. A single fluid outlet 38 communicates with the interior of sections 39, 40 as will be discussed. FIG. 4 shows the pump 10 of FIG. 3 with the impeller housing 14 removed therefrom for convenience of illustration.

Figure 5:
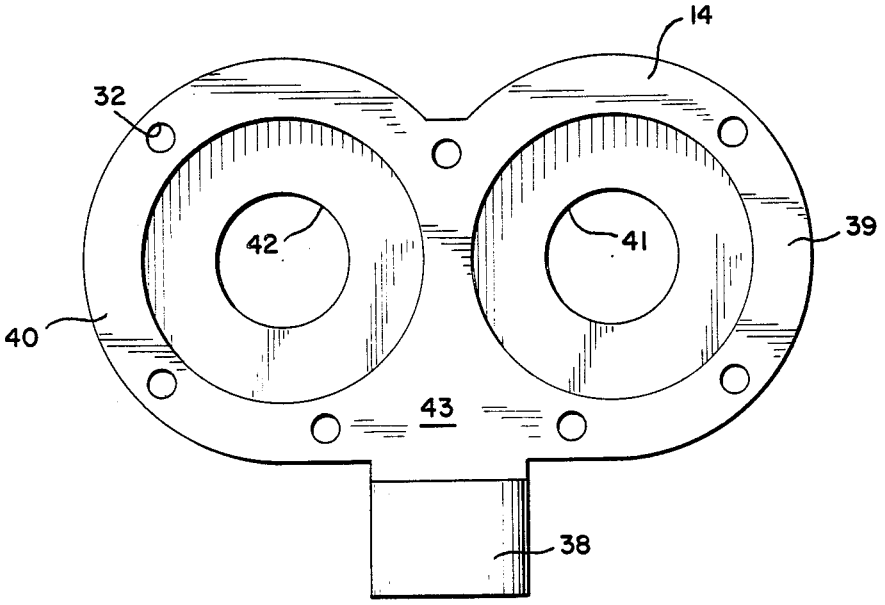
FIG. 5 is a bottom plan view of one component of the pump of FIGS. 1 to 4.
Figure 6:
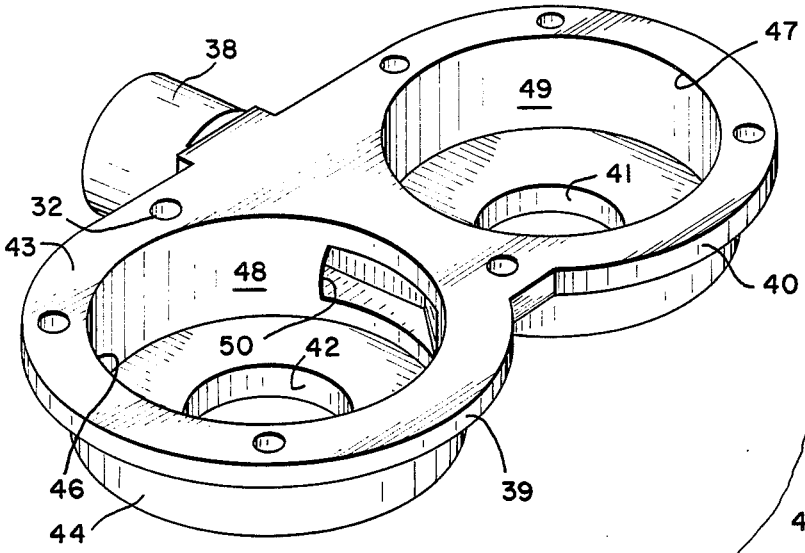
FIG. 6 is a bottom perspective view of the impeller housing of FIG. 5.
Figure 7:
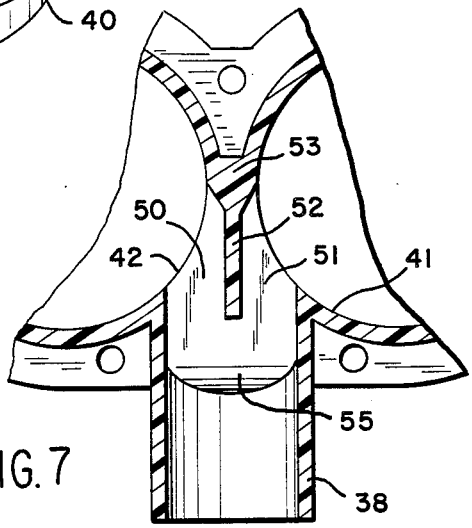
FIG. 7 is a view taken along lines VII—VII of FIG. 2.

FIG. 5 is a bottom plan view of the impeller housing 14 alone of the pump 10 removed therefrom for convenience of illustration. Housing 14 is comprised of a figure eight shaped bottom planar member 43 having a peripheral side wall 44 (FIG. 2) and a top wall 45 having openings 41, 42 formed therein. Outlet 38 is preferably cylindrical and hollow (see particularly FIG. 1) extending through the peripheral wall 44. This can be seen by comparing FIGS. 2, 6 and 7. Each section 39, 40 has a bottom opening 46, 47, respectively, formed in bottom wall 43. The interior side walls 48, 49, respectively, of each section 39, 40 have openings 50, 51 respectively, therein (see FIG. 7 for opening 51). The opening 50 through side wall 48 is separated from the opening 51 through side wall 49 by a divider wall 52 (FIG. 7). This divider wall 52 extends from the solid part 53 at the intersection of sections 39, 40 to a point just before opening into outlet 38. The upper ceiling and lower ramp portions 54, 55, respectively, (FIGS. 2 and 7) in outlet 38 may be thickened to provide ramps leading to the inner cylindrical wall 87 of outlet 38 to vary the volumetric capacity of outlet 38. Thus, the volumetric capacity obtained by the openings 50, 51 through walls 48, 49 and outlet 38 may be predetermined and controlled by proper selection of the wall thickness of wall 52, the elongated extend thereof, the inner diameter of outlet 38, the reduction in internal capacity of outlet 38, by thickening or thinning the inner wall portions thereof, etc. However, for purposes of the invention, it can be seen that introduction of fluid from each section 39, 40 through its respective opening 50, 51 results in the fluid abutting against common wall 52 and flowing therepast and combining together to flow out of outlet 38 which thus acts as a mixing chamber. These dimensions can all be preselected to provide a desired outflow from outlet 38.

As can be seen in FIGS. 3 and 4, each impeller 20, 21 may have a plurality of blades, such as two. Of course, more than two such blades may be provided. Impeller 20 is the mirror image of impeller 21. Also, as seen in FIG. 4, the blades 83, 84 of impeller 20 preferably extend radially and tangentially from hub 29 in opposite directions and lie in planes spaced from but parallel to each other. Blades 85 and 86 of impeller 21 extend similarly but are the mirror image of blades 83, 84. Impeller 20 is rotated, via shaft 18, in the direction of arrow 56 (FIG. 3) whereas impeller 21 is rotated, via shaft 19, in the opposite direction (indicated by arrow 57). This results in fluid entering pump 10 via openings 41, 42 being pushed by impellers 20, 21 into openings 50, 51, respectively (see the dotted lines in FIG. 3 and arrows 58, 59, respectively) where the fluid abuts wall 52 and enters into outlet 38 where the fluid flow is combined, as indicated by arrow 60, and flows out of outlet 38 as indicated by arrow 61.

Thus, the flow from each impeller housing section 39, 40 merges into a chamber (openings 50, 51, wall 52) to deliver an efficient rate of flow. The pump casing is compact and, if one motor fails, the pump will still operate, albeit at a lower efficiency, and thus is very useful in critical applications. The separately powered shafts counterrotate for improved efficiency and assist in moving the fluid into the mixing chamber.

Figure 8:
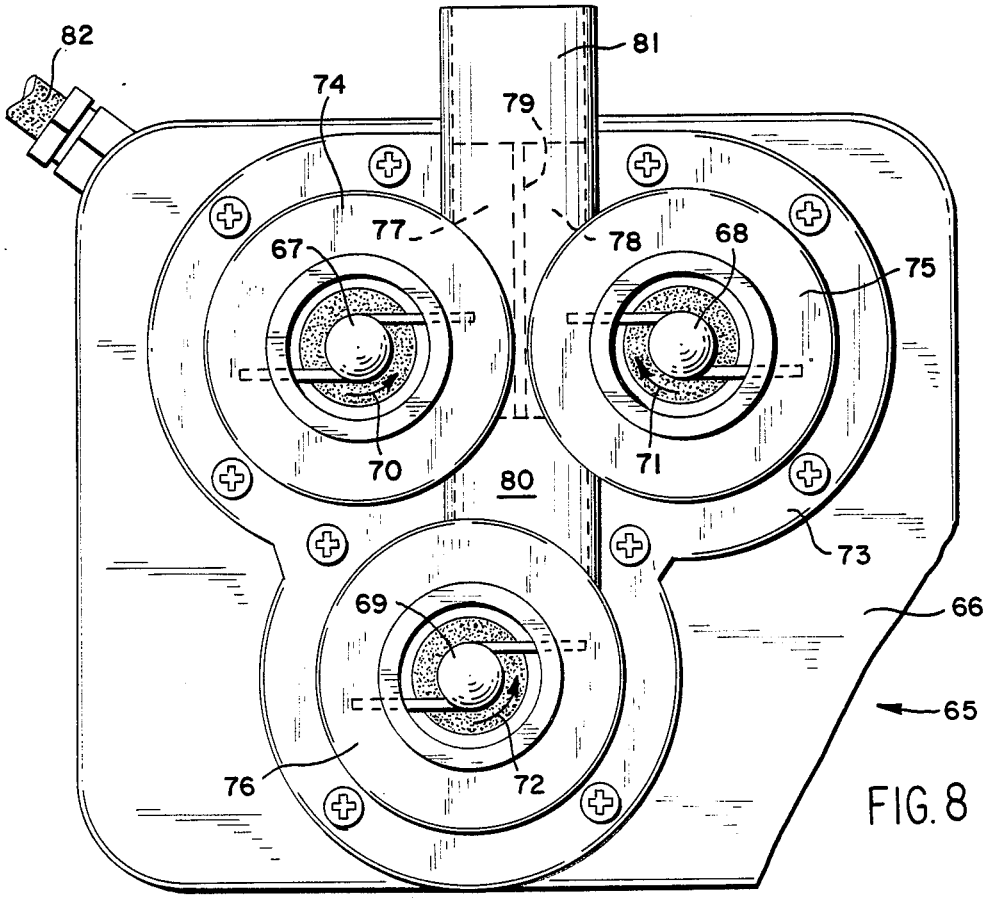
FIG. 8 is a view similar to FIG. 3 showing a modification of the pump of FIGS. 1 to 7.

Although two impellers and motors are disclosed, obviously more than two may be combined in a single housing with an impeller housing having three sections feeding fluid from each section into a common outlet. This is shown in FIG. 8 wherein pump 65 has a motor housing 66 as discussed hereinabove and a plug 82 otherwise similar to the pump of FIGS. 1 to 7 except that three separate motors (not shown) are provided in housing 66 rotating three impellers 67 through 69. Each impeller 67 through 69 is rotated in the direction indicated by arrows 70 through 72, respectively, within an impeller housing 73. Housing 73 is divided into three impeller sections 74 to 76 similar to sections 39, 40 heretofore described. Openings 77 and 78 (see the dotted lines in FIG. 8) are provided in the inner walls of sections 74, 75 similar to openings 50, 51 heretofore discussed separated by a wall 79 otherwise similar to wall 52. An opening 80 communicates with the interior of section 76 and the openings 77, 78 so that fluid is forced out of section 76, through opening 80, about wall 79 and out outlet 81 in the manner heretofore discussed. Thus, three independently operated motors can be used in a single pump for increased fluid flow. Of course, impeller 69 would rotate in the same direction as impeller 67 and be identical thereto.

Any suitable materials may be used. State of the art materials may be used throughout, such as polypropolene for the screen filter 33, neoprene for the electrical conduit 17, nylon for the impellers and their housings, etc. Brass, aluminum and stainless steel may be used where possible. Suitable bearings and electronic overload protection may be provided. The filter 33 may be eliminated, if desired. The pump of the invention may be provided in varying sizes and flow rates and may be operated fully submerged or in open air and operated in any position. The pump motors and other internal equipment are preferably permanently sealed in oil for lifetime lubrication, quiet running and rapid heat dissipation. The invention herein results in a substantial increase in efficiency and reliability with a corresponding decrease in initial and ongoing cost and maintenance. The invention herein enables the pump to be extremely useful in those applications where pump failure cannot be tolerated, such as in critical hospital applications.

It can be seen that I have described an improved pump combining the effect of two separate pumps and separate motors and related components into a single, compact highly efficient unit.

I claim:

1. A multiple impeller pump comprising:

a motor housing containing therein at least a pair of motors, each of said motors having a shaft rotatable thereby, one of said motors being reversible with respect to the other of said motors so that the respective shafts thereof may be rotated simultaneously in opposite directions;

an impeller housing mounted to said motor housing receiving said shafts therein, said impeller housing being divided into at least a pair of sections, one of said sections being adjacent the other separated by a wall and one of said shafts extending into the interior of one of said sections and another of said shafts extending into the interior of the other of said sections, each of said sections having a fluid inlet leading into the interior thereof and an impeller fixedly secured to each of said shafts for rotation therewith; and a fluid outlet leading from said impeller housing in fluid communication with the interior of each of said impeller housing sections, fluid communication between said outlet and the interior of said sections being provided by an opening through said wall separating said sections in fluid communication with said fluid outlet, said opening through said wall in one of the said sections being separated from the opening through said wall in the other of said sections by a partition wall whereby fluid entering the fluid inlets in each of said sections is pushed by said impellers through said openings against said partition wall and out of said fluid outlet, said wall separating said sections comprising a fixed integral wall common to said outlet forming the top and bottom thereof with the openings in said sections through said wall separating said sections extending from and are flush with the interior wall of each of said sections through said common wall to said outlet, said partition wall being a continuation of a portion of said common wall interiorly of the openings through said common wall and generally parallel to the longitudinal axis of said outlet.

2. In the pump of claim 1 wherein each of said impellers has a central hub fixed to its respective shaft and a plurality of spaced blades extending radially from said hub.

3. In the pump of claim 2 wherein at least two blades are on each impeller the blades of said impellers extend tangentially from and on opposite sides of its respective hub in opposite directions and lie in planes spaced from each other and substantially parallel to each other.

4. In the pump of claim 3 where the blades on one of said impellers are the mirror image of the blades on the other of said impellers, the impeller in one of said sections being rotated in a clockwise direction to force fluid through the opening in said wall separating said sections and against said partition wall and into said outlet with the impeller in the other of said sections being rotated in a counterclockwise direction to force fluid through the opening in said wall separating said sections and against said partition wall and into said outlet.

5. In the pump of claim 1 wherein three such pump motors are provided, each of said motors having a shaft rotated thereby, each of said shafts extending into a section of an impeller housing, two of said sections being adjacent each other and the shafts extending therein being rotatable in opposite directions, the third section being disposed adjacent the abutment of said two of said sections and rearwardly thereof and having a pump shaft extending therein rotatable in a direction the same as the direction of rotation of one of said shafts in one of said two of said sections, said wall separating said sections separating all of said sections from each other and the opening in each of said sections communicating with said outlet.

6. In the pump of claim 1 wherein said partition wall terminates at a point just before said openings through said common wall open into said outlet.

7. In the pump of claim 6 wherein said outlet includes upper and lower wall portions of thickened material thereby reducing the volumetric capacity of said outlet.

8. In the pump of claim 6 wherein said outlet is generally cylindrical having an inner cylindrical wall.

9. In the pump of claim 8 wherein said outlet has spaced upper and lower ramp portions extending from said partition wall to the inner cylindrical wall of said outlet.

* * * * *